US009446870B1

(12) United States Patent
Cameron et al.

(10) Patent No.: US 9,446,870 B1
(45) Date of Patent: Sep. 20, 2016

(54) AUTOMATIC SILVERWARE WRAPPING SYSTEM

(75) Inventors: Eric Cameron, Panama City Beach, FL (US); John Helsel, Panama City Beach, FL (US)

(73) Assignee: Quiq Silver Inc, Niceville, FL (US)

( * ) Notice: Subject to any disclaimer, the term of this patent is extended or adjusted under 35 U.S.C. 154(b) by 576 days.

(21) Appl. No.: 13/589,741

(22) Filed: Aug. 20, 2012

(51) Int. Cl.
*B65B 11/10* (2006.01)
*B65B 11/16* (2006.01)
*B65B 11/04* (2006.01)

(52) U.S. Cl.
CPC ..... *B65B 11/10* (2013.01); *B65B 11/04* (2013.01); *B65B 11/16* (2013.01)

(58) Field of Classification Search
CPC ..... B65B 27/10; B65B 27/105; B65B 11/00; B65B 11/08; B65B 11/10; B65B 11/16; B65B 11/56
USPC ..... 53/210, 211, 215, 216, 203, 147, 148, 53/154; 493/480, 959, 955
See application file for complete search history.

(56) References Cited

U.S. PATENT DOCUMENTS

| | | | | |
|---|---|---|---|---|
| 5,469,688 | A * | 11/1995 | Dunbar et al. | 53/419 |
| 6,023,908 | A * | 2/2000 | Vetsch | 53/155 |
| 6,023,913 | A * | 2/2000 | Gray et al. | 53/399 |
| 6,918,226 | B2 * | 7/2005 | Heilman et al. | 53/211 |
| 7,076,932 | B2 * | 7/2006 | Rubin | 53/461 |
| 7,210,279 | B1 * | 5/2007 | Ahmed et al. | 53/155 |
| 7,322,172 | B2 * | 1/2008 | Hoffman et al. | 53/586 |
| 2002/0112445 | A1 * | 8/2002 | Scaduto | 53/167 |
| 2002/0124534 | A1 * | 9/2002 | Heisey | 53/466 |
| 2008/0302066 | A1 * | 12/2008 | Lavi | 53/399 |

* cited by examiner

*Primary Examiner* — Thanh Truong
*Assistant Examiner* — Dianne Mitchell
(74) *Attorney, Agent, or Firm* — Shifrin Patent Law; Dan Shifrin

(57) ABSTRACT

An automatic silverware wrapping system uses a series of utensil holding magazines that dispense their wares down a chute and onto a napkin holding carrier platen that advances through the system. Once the silverware is on the napkin, an intermediate fold is imparted onto one of the corners of the napkin and then end folds are imparted onto two other corners. Thereafter, the partially folded napkin and its utensils drop down to a pair of roller bearing rails that counter rotate relative to each other in order to roll the napkin up around the silverware.

17 Claims, 3 Drawing Sheets

AUTOMATIC SILVERWARE WRAPPING SYSTEM

BACKGROUND OF THE INVENTION

1. Field of the Invention

The present invention relates to a machine that automatically wraps silverware within a napkin.

2. Background of the Prior Art

One of the tasks for restaurant servers is to wrap silverware in a napkin. In the modern world, where hygiene and cleanliness are prime considerations for restaurant selection, many people perceive a wrapped and possibly banded set of silverware to be superior from a cleanliness perspective than simply placing the silverware upon a napkin in open face fashion. As such, dozens or even hundreds (depending on the size of the restaurant and the volume anticipated) of wrapped silverware napkin sets are prepared so that an ample supply is on hand whenever the restaurant is busy and table turnaround speed is a critical factor for a successful meal rush. A bus boy cleans the table, grabs a few previously prepared wrapped silverware napkin sets, places the napkin sets on the table, and the table is ready to be sat by incoming customers. This system allows for efficiency in table turnover which is critical during peak times.

Typically, the very dull and tedious task of the silverware wrapping task falls on the wait staff either at the start of the shift or at the end of the shift when the wait person is not otherwise taking care of customers. While efficient, this task has certain drawbacks. Wrapping silverware means that the wait person is not serving customers, and is therefore, not earning tips which account for the lion's share of most wait person's income. When the silverware wrapping task falls to the end of the shift, as is often the case with lunch staff, the waiter or waitress, being finished with the tip garnering wait task, and having a pocket full of tip money, is anxious to leave work and considers the requirement of silverware wrapping to be tedious drudgery. As such, many wait people fly through the wrapping task unconcerned with the quality of the finished product so that the next shift is faced with less the properly presentable wrapped silverware, possibly requiring a rewrap or simply giving the customer less than the expected quality of service. Every restaurant manager understands the critical importance of a good first impression upon customers, including a nicely presented silverware packet so that an improper initial presentation is to be avoided. Additionally, some wait people try to get a jump on the silverware wrapping task by wrapping silverware as the customer load slows down. Unfortunately, many people become tunnel focused on the task at hand so that any remaining tables being served by that wait person suffer from poor service.

Another problem is encountered if the wrapped silverware available for placement on top a table runs out during a shift, either from inadequate supply left by the previous shift or by unexpected volume during the present shift. In either case, one or more restaurant personnel must stop what they are doing and wrap more silverware with the attendant suffering of service in those particular employees' responsibility areas.

And of course, the restaurant must pay the staff for the wrapping task, which multiplied over time, comes up to be a pretty penny.

To address these concerns, silverware wrapping machines have been proposed. These devices are loaded with napkins and silverware and wrap the silverware within the napkin, in either a fully automatic or partially automatic fashion, thereby relieving the staff from some or all of the silverware wrapping task. These devices, which come in a wide variety of architectures and work with varying degrees of efficiency, also suffer from certain drawbacks. Many such prior art devices are very complex in design and construction so that they are relatively very expensive to produce, purchase and maintain. As a result, only larger restaurants that have a high volume over which to amortize the costs can economically afford to purchase such devices. Additionally, many of these devices have a large real estate footprint which requires setting aside a large area within the restaurant for these devices. As space is at a premium in many restaurants, especially in the back of the house, such devices tend to be too large to be placed into the restaurant. Furthermore, many of the semi-automatic devices require substantial human interchange with the device so that the saving in employee time is slight and does not justify the investment in such devices.

What is needed is an automatic silverware wrapping system that wraps silverware within a napkin, so as to achieve a professional appearing silverware packet, which system overcomes the stated shortcomings found in the prior rt. Such a system must be able to wrap the silverware within a napkin without undue interaction with the restaurant employees in order to allow the restaurant to be able to realize significant employee cost savings. Such a system must not be unduly complex so that the system is relatively simple and straightforward to produce so as to keep the costs low in order to allow a restaurant to obtain such a device in an economical fashion. Such a device must be reasonably compact so as not to require a large amount of the valuable real estate within a restaurant.

SUMMARY OF THE INVENTION

The automatic silverware wrapping system of the present invention addresses the aforementioned needs in the art by providing a system that is loaded with silverware and napkins, and thereafter wraps individual portions of the silverware within individual napkins and with the overall wrapped packet being profession and uniform in appearance so as to give a customer sitting down at a table a positive first impression at the table. The automatic silverware wrapping system is substantially automated so that employee interaction with the system is very modest thereby allowing a restaurant to achieve significant employee cost savings by employing the present invention. The automatic silverware wrapping system is relatively simple in design and construction, being produced using standard manufacturing techniques, so that the system is reasonably inexpensive to purchase so that the system is economical to potential customers of the automatic silverware wrapping system. The automatic silverware wrapping system is relatively compact in its foot print so as not to occupy an unnecessarily large amount of the valuable real estate within a restaurant.

The automatic silverware wrapping system of the present invention is comprised of a support base that has a first end and an opposing second end joined by a first side and an opposing second side. A plate is secured to the base and is located proximate the first end and holds a stack of the napkins (typically generally rectangular, but at least having a leading corner that faces toward the second end of the base and a pair of opposing side corners located 180 degrees apart and each 90 degrees apart from the leading corner). A means for dispensing is located atop the support base proximate the plate such that the means for dispensing dispenses an item of the utensil onto the napkin. A means for imparting a first fold is located atop the support base proximate the means for dispensing such that the means for imparting a first fold folds the leading corner of the napkin over onto the body of the napkin so as to at least partially overlie the utensil atop the napkin. A means for imparting second folds is located atop the support base proximate the means for imparting a first fold such that the means for imparting second folds folds each of the side corners of the napkin toward each other and over onto the body of the napkin so as to at least partially overlie the utensil atop the napkin. A means for rolling is located below the means for imparting second fold such that the means for rolling the napkin body about the utensil. A platen takes one of the napkins off of the stack and positions the napkin onto the platen and position the napkin underneath the means for dispensing in order to allow the means for dispensing to function (drop one or more utensil items onto the napkin), and thereafter the platen transports the napkin and utensil to the means for imparting a first fold in order to allow the means for imparting a first fold to function (folding leading corner onto the body of the napkin and at least partially over the utensil), and thereafter the platen transports the napkin and utensil to the means for imparting second folds in order to allow the means for imparting seconds folds to function (folds side corners onto body of the napkin and at least partially over the utensil), and thereafter the platen causes the napkin and utensil to gravitationally fall to the means for rolling in order to allow the means for rolling to function (rolls napkin about the utensil). The platen has a gripping finger that actuates to grippably seize one of the napkins off of the stack and place the napkin onto the platen. The means for dispensing comprises a housing and a chute having a door located below the housing such that the platen passes underneath the chute. At least one magazine is provided and each holds a number of the utensils. The magazine has a trigger, that, when actuated, dispenses a single item of the utensil from the magazine into the chute. The magazine held within the housing. The trigger is actuated so as to dispense the utensil into the chute and such that whenever the platen holding the napkin is underneath the chute, the door opens to allow the utensil within the chute to gravitationally drop onto the napkin on the platen and thereafter the door closes. The magazine has a central cavity such that all of the utensils held therein are held in uniformly stacked fashion within the cavity. The means for imparting a first fold comprises a fold plate that is capable of pivotally articulating from a normally relaxed position toward the first end of the base such that whenever the leading corner of the napkin is positioned overtop the fold plate, the fold plate pivotally articulates toward the first end, thereby folding the leading corner onto the body, the fold plate thereafter returning to the relaxed position. The means for imparting second folds comprises a pair of fold forks that articulate toward each other and then away from each other to a ready state such that when the platen is located proximate the pair of fold forks, the fold forks articulate toward each other thereby each fold fork folding a respective one of the side corners onto the napkin body, and thereafter the fold forks return to the ready state. The means for imparting second folds further comprises a pair of guide plates each located proximate a respective one of the fold forks, such that a portion of the napkin is located underneath the guide plates whenever the fold forks articulate toward each other. The platen has a first section and a second section, the first section and the second section capable of opening downwardly away from each other, and thereafter closing, all in trap door fashion, such opening allowing the napkin and utensil to gravitationally fall to the means for rolling. The platen travels back and forth along a track attached to the support base under control of a motor. The means for rolling comprises a pair of rails, a first roller located proximate one of the pair of rails, and a second roller located proximate the other of the pair of rails. Whenever a napkin and utensil combination falls between the pair of rails, the first roller and the second roller each rotate in opposing directions thereby rolling the napkin about the utensil.

BRIEF DESCRIPTION OF THE DRAWINGS

Similar reference numerals refer to similar parts throughout the several views of the drawings.

DESCRIPTION OF THE PREFERRED EMBODIMENT

Figure 1:
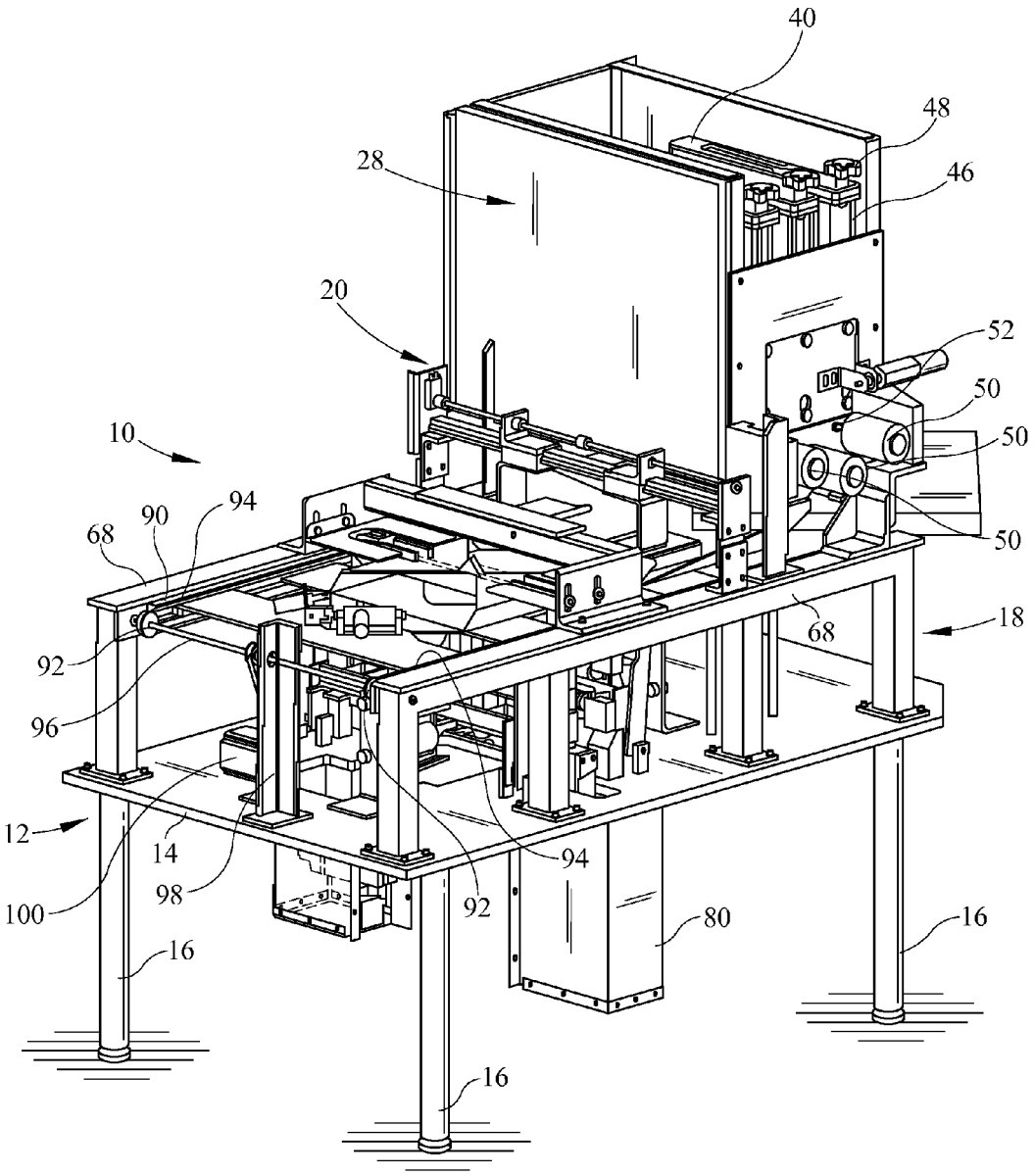
FIG. 1 is a first side perspective view of the automatic silverware wrapping system of the present invention.
Figure 2:
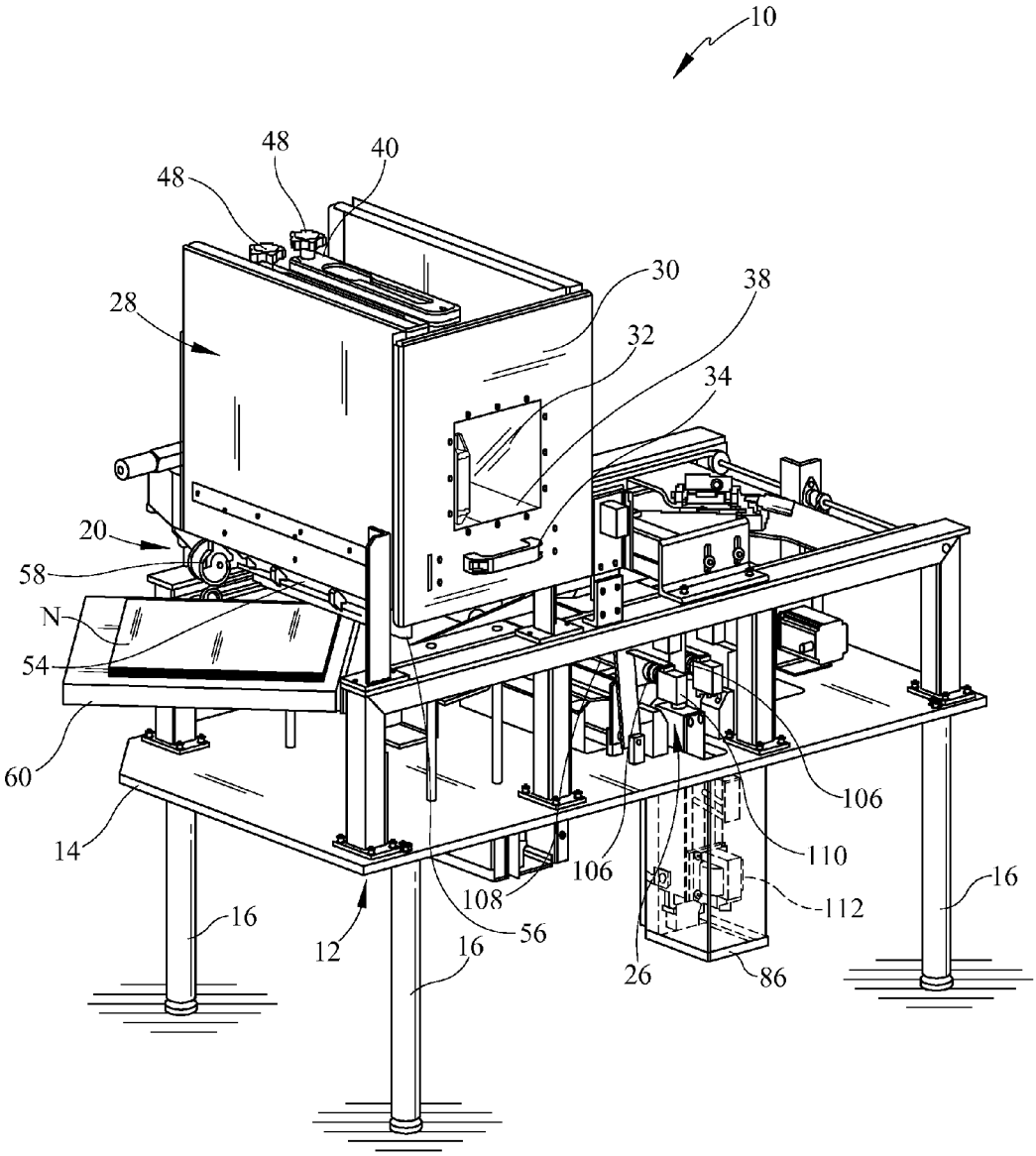
FIG. 2 is an opposing second side perspective view of the automatic silverware wrapping system.
Figure 3:
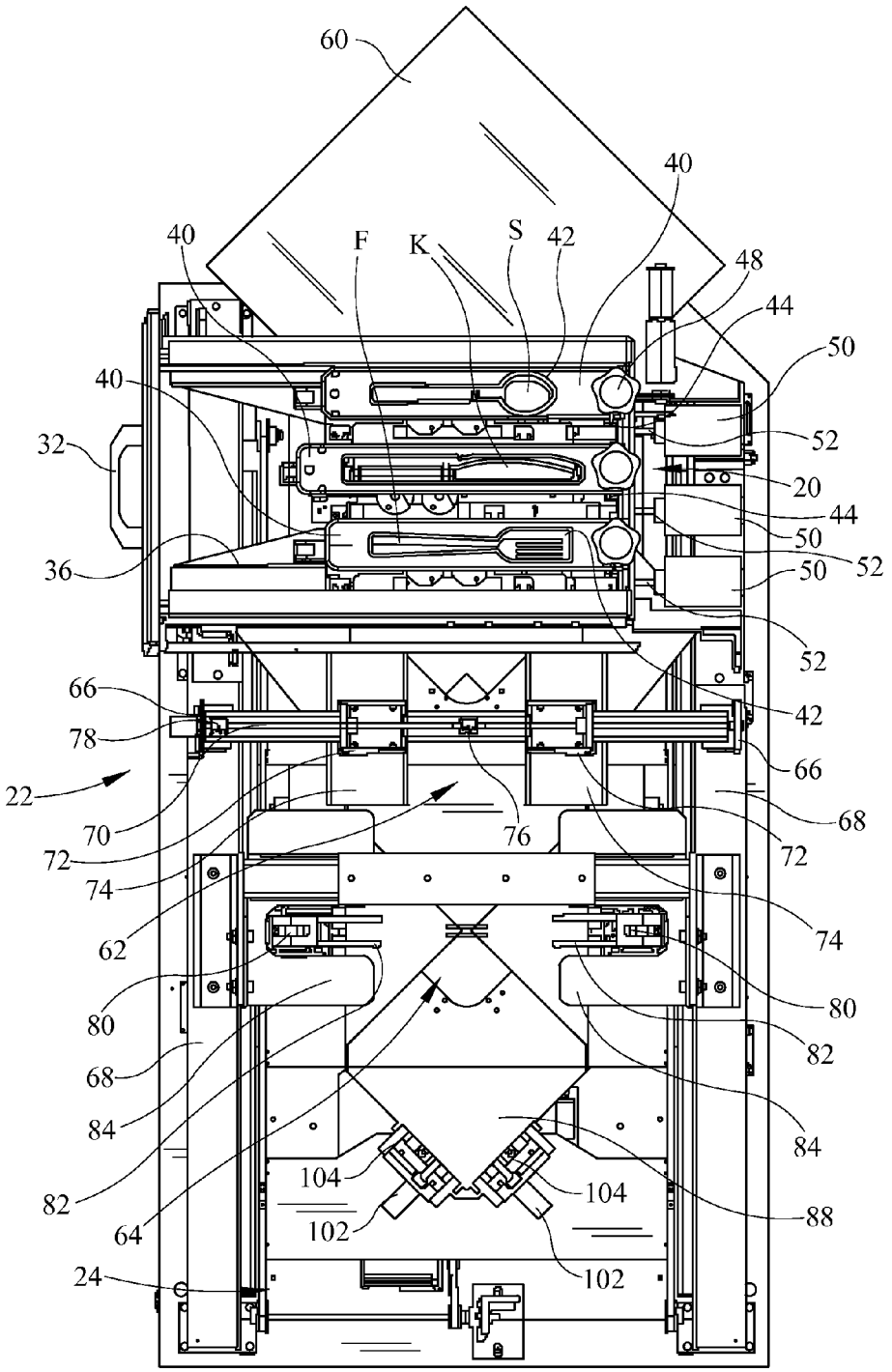
FIG. 3 is a top plan view of the automatic silverware wrapping system.

Referring now to the drawings, it is seen that the automatic silverware wrapping system of the present invention, generally denoted by reference numeral 10, is comprised of a table 12 having a base 14 and a series of support legs 16. A frame member 18 is attached to the base 14 of the table 12 and holds the various subsystems of the device 10, including the silverware dispensing system 20, the napkin folding system 22, the napkin advancement system 24, and the napkin rolling system 26.

The silverware dispensing system 20 comprises a housing 28 that has an access door 30, which may have a window 32 to allow users to be able see thereinto and a handle 34 for ease of opening and closing the door 30. A pull out drawer 36 is disposed within the housing 28, the drawer 36 being capable of sliding along a pair of guide rails 38 held within the housing 28, so that the drawer 36 is able to slide partially out of the housing 28 through the open door 30 for ease of access to the drawer 36. Removably attachable to the drawer 36 is a series of magazines 40. As seen, each magazine 40 is a generally rectangular housing member that has an cavity 42 extending along its height, the cavity 42 being in the shape of one type of silverware, such as a knife K, a fork F, or a spoon S. Each item of silverware, K, F, or S is stacked within its respective magazine 40. The bottom of each magazine 40 has a dispenser 44, that when triggered, allows precisely one of the items of silverware K, F, or S, held within that particular magazine 40. Each magazine 40 is loaded onto the drawer 36 and is locked to the drawer 36 via a threaded rod 46 controlled by a control knob 48 so that when the magazine 40 is loaded onto the drawer 36 (appropriate guides being located on the drawer 36 (not illustrated), which drawer 36 has been slid out of the housing 28 for ease of access, the control knob 48 is rotated in order to threadably lock the magazine 40 to the drawer 36. As seen, solenoids 50, each having a actuator rod 52, are positioned, one solenoid 50 and actuator rod 52 set each proximate a respective one of the magazines 40 (or one solenoid can be configured to control all of the actuators 52), such that the actuator rod 52, under control of the solenoid, engages the dispenser 44 of its respective magazine 40, in order to allow silverware K, F, or S to be dispensed out of each magazine 40.

The silverware dispensing system 20 is illustrated with three magazines 40 loaded within the housing 28, as the common silverware configuration for many restaurants tends to be a knife K, a fork F, and a spoon S, however, it is recognized that the silverware dispensing system 20 can be upsized in order to accommodate additional magazines 40, for example, for restaurants that provide separate salad and dinner forks, and/or soup as well as coffee spoons with each silverware setting. Additionally, in situations when less than the maximum amount of magazines 40 is to be utilized, for example, a restaurant may desire only a fork F and spoon S configuration, then any additional magazines 40 that are capable of being located within the drawer 36 are simply not loaded, or are loaded but empty of their cargo (however, if the silverware dispensing system 20 has means for shutting down operation and possibly alerting personnel if one of the magazines 40 is empty, then in such a scenario, the magazine 40 is not loaded into the drawer 36 so as to not trigger a magazine empty shutdown, the silverware dispensing system 20 recognizing that no magazine 40 is present in one or more of the slots of the drawer 36, bypasses that magazine location in making its magazine empty determination).

It is also recognized that a single magazine 40 with more than one cavity is anticipated by the present invention. In such an architecture, a single actuator can control the entire dispensing process (the system allowing an operator to disable one or more of the individual cavities within the magazine so that if the magazine is a three cavity magazine and only a single fork and a single spoon is to be dispensed, then the third cavity (probably holding knives) is "disabled" so that the system does not detect a cavity empty situation and stop production). Alternately, each cavity within this single magazine architecture can have its own actuator.

Located below the magazines 40 is a chute 54 having a door 56, the opening and closing of this door 56 controlled by an actuator 58.

Located below the chute 54 is a napkin sheet stack 60 upon which napkins are loaded.

The napkin folding system 22 is comprised of two subsystems, namely the intermediate fold system 62, and the end fold system 64.

The intermediate fold system 62 comprises a pair of end brackets 66, each attached to a respective one of the side rails 68 of the frame member 18. A bearing rail 70 extends between the end brackets 66 and has a pair of bearings 72 located thereon in spaced apart fashion, each of the bearings 72 has a fold plate 74 attached thereto, the bearings 72 under the control of a drive screw 76, which operates the bearings 72, which bearings 72 cause their respective fold plates 74 to flip up and over the bearing rail 70 toward the silverware dispensing system 20, and to return. The drive screw 76 is itself controlled by a drive motor 78 located on one end of the bearing rail 70.

The end fold system 64 comprises a pair of actuators 80 that each actuate an end fold fork 82, each actuator 80 and end fold fork 82 located proximate a napkin hold down guide plate 84, the actuators 80 being held within an actuator housing 86 that depends downwardly from the table 14.

The napkin advancement system 24, which takes napkins N from station to station, is comprised of a carrier platen 88 that slides along a pair of carrier rails 90 that are attached to the side rails 68 of the frame member 18. The carrier platen 88 is two sectioned by being split in the middle as seen so as to allow the platen 88 to open up in and thereafter close in trap door fashion, under the control of appropriate actuators (not illustrated). As seen, located on the end of each carrier rail 90 is a drive pulley 92 that has a drive belt 94 thereon, the drive belts 94 each connected to the carrier platen 88, the opposing end of the belts 94 is a driven pulley (not illustrated). The two drive pulleys 92 are connected by a drive shaft 96 that passes through an appropriate shaft support 98. A motor 100 is operationally connected to the drive shaft 96 in order to rotate the drive shaft 96, which in turn rotates the drive pulleys 92 which in turn moves the drive belts 94, thereby moving the carrier platen 88. A pair of gripper fingers 102 is located on an end of the carrier platen 88 and each is controlled by actuators 104.

The napkin rolling station 26 is located below the napkin folding station 22 and is comprised of a series of rollers 106 that are supported on a pair of roller rails 108, the two rails 108 being controlled by a drive motor 110.

Appropriate control circuitry 112 is provided for controlling the various motors, actuators and overall timing of the system 10.

In order to operate the automatic silverware wrapping system 10 of the present invention, each magazine 40 is loaded with the appropriate silverware, and each magazine 40 is loaded and secured into the pullout drawer 36. Napkins N are loaded onto the napkin sheet stack 60. The device 10 is ready for operation. Initially, the carrier platen 88, in closed configuration, is moved to the napkin sheet stack 60 and grabs a single napkin off of the sheet stack 60 via the gripper fingers 102. The gripper fingers 102 are adjusted as needed to assure that only a single napkin N is removed. Once the napkin N is on the carrier platen 88, the carrier platen 88 moves underneath the chute 54. The solenoid 50 actuate its actuator rod 52 causing the actuator rod 52 to trigger the dispenser 44 of each magazine 40 in order to dispense a single item of silverware into the chute 54. Each solenoid 50 performs in this fashion so that each magazine 40 dispenses a utensil item. Once an item of silverware is dispensed from each magazine 40, the chute door 56 is opened via its actuator 58, allowing the silverware within the chute 54 to gravitationally drop onto the napkin N located therebelow, the chute door 56 thereafter closing. The chute 54 assures proper alignment of the items of silverware so that the silverware drop onto the napkin N in this proper alignment. Once the silverware is dispensed onto the napkin N from the chute 54, the carrier platen 88 advances to the intermediate fold system 62, whereat a corner of the napkin (the corner pointing toward the shaft support 96) is folded onto the remainder of the napkin N via the fold plates 74, with the fold plates 74 flipping up and over the bearing rail 70 toward the silverware dispensing system 20, thereby folding the leading corner of the napkin N onto the silverware bearing body of the napkin, and thereafter the fold plates return to their initial position, the fold plates 74 operated by the drive screw 76, itself driven by the motor 78. Thereafter, the carrier plate 88 advances to the end fold system 64 wherein the two corners of the napkin that are each 90 degrees apart from the corner just folded, are themselves folded via the end fold forks 82, the end fold forks 82 flipping the two corners of the napkin N onto the silverware bearing body of the napkin, the end fold forks 82 operated by the actuators 80. With the napkin N folded, the platen 88 is positioned overtop the napkin rolling station 26. The platen 88 opens along its central split as described previously in order to allow the silverware bearing napkin N to gravitationally drop between the roller rails 108 whereat the counterrotating rollers 106 rotate in order to roll the napkin N with the silverware therein. The napkin N is now properly rolled about the silverware. A trap drop then opens gravitationally releasing the rolled napkin into an appropriate holding bin (neither illustrated).

The control circuitry 112 controls the various motors and actuators. Appropriate sensors are positioned on the device in order to provide the control circuitry the necessary feedback to control the timing of the various motors and actuators including sensors that can detect a snag in the system (magazine 40 or napkin stack empty, actuator not operating, a jam along the path, etc.) in order to halt operation and possibly send an appropriate signal to appropriate personnel.

While the invention has been particularly shown and described with reference to an embodiment thereof, it will be appreciated by those skilled in the art that various changes in form and detail may be made without departing from the spirit and scope of the invention.

We claim:

1. A silverware wrapping system for wrapping a napkin about a utensil, the napkin being a sheet member with a body member with a leading corner and a pair of opposing side corners, the silverware wrapping system comprising:

a support base having a first end and an opposing second end joined by a first side and an opposing second side:

a plate secured to the support base and located proximate the first end and adapted to hold a stack of the napkins thereon, each of the napkins having its leading corner facing toward the second end of the support base;

means for dispensing located atop the support base proximate the plate, the means for dispensing adapted to dispense an item of the utensil onto the napkin;

means for imparting a first fold located atop the support base proximate the means for dispensing, the means for imparting a first fold adapted to fold the leading corner of the napkin over onto a body portion of the napkin so as to at least partially overlie the utensil atop the napkin;

means for imparting second folds located atop the support base proximate the means for imparting a first fold, the means for imparting second folds adapted to fold each of the side corners of the napkin toward each other and over onto the body portion of the napkin so as to at least partially overlie the utensil atop the napkin;

means for rolling located below the means for imparting second folds, the means for rolling adapted to roll the napkin about the utensil; and wherein a gripping finger is adapted to take one of the napkins off of the stack and place onto the platen and position the napkin underneath the means for dispensing in order to allow the means for dispensing to function, and thereafter the platen transports the napkin and utensil to the means for imparting a first fold in order to allow the means for imparting a first fold to function, and thereafter the platen transports the napkin and utensil to the means for imparting second folds in order to allow the means for imparting seconds folds to function, and thereafter the platen causes the napkin and utensil to gravitationally fall to the means for rolling in order allow the means for rolling to function.

2. The silverware wrapping system as in claim 1 wherein the means for dispensing comprises:

a housing;

a chute having a door located below the housing such that the platen passes underneath the chute;

a magazine adapted to hold a number of the utensils, the magazine having a trigger, that, when actuated, dispenses a single item of the utensil from the magazine into the chute, the magazine held within the housing; and wherein the trigger is actuated so as to dispense the utensil into the chute and such that whenever the platen holding the napkin is underneath the chute, the door opens to allow the utensil within the chute to gravitationally drop onto the napkin on the platen and thereafter the door closes.

3. The silverware wrapping system as in claim 2 wherein the magazine has a central cavity such that all of the utensils held therein are held in uniformly stacked fashion within the central cavity.

4. The silverware wrapping system as in claim 2 wherein the means for imparting a first fold comprises a pair of fold plates that is capable of pivotally articulating from a normally relaxed position toward the first end of the support base such that whenever the leading corner of the napkin is positioned overtop the fold plates, the fold plates pivotally articulate toward the first end, thereby folding the leading corner onto the body portion of the napkin, the fold plates thereafter returns to the relaxed position.

5. The silverware wrapping system as in claim 4 wherein the means for imparting second folds comprises a pair of fold forks that articulate toward each other and then away from each other to a ready state such that when the platen is located proximate the pair of fold forks, the fold forks articulate toward each other, each fold fork folding a respective one of the side corners onto the body portion of the napkin, and thereafter the fold forks return to the ready state.

6. The silverware wrapping system as in claim 5 wherein the means for imparting second folds further comprises a pair of guide plates each located proximate a respective one of the fold forks, such that a portion of the napkin is located underneath the guide plates whenever the fold forks articulate toward each other.

7. The silverware wrapping system as in claim 5 wherein the platen comprises a first section and a second section, the first section and the second section capable of opening downwardly away from each other and thereafter closing all in trap door fashion, such opening allowing the napkin and utensil to gravitationally fall to the means for rolling.

8. The silverware wrapping system as in claim 7 wherein the platen travels back and forth along a track attached to the support base under control of a motor.

9. The silverware wrapping system as in claim 8 wherein the means for rolling comprises:

a pair of rails;

a first roller located proximate one of the pair of rails;

a second roller located proximate the other of the pair of rails; and such that whenever a napkin and utensil falls between the pair of rails, the first roller and the second roller each rotate in opposing directions thereby rolling the napkin about the utensil.

10. The silverware wrapping system as in claim 1 wherein the means for dispensing comprises:

a housing;

a chute having a door located below the housing such that the platen passes underneath the chute;

a magazine adapted to hold a number of the utensils, the magazine having a trigger, that, when actuated, dispenses a single item of the utensil from the magazine into the chute, the magazine held within the housing; and wherein the trigger is actuated so as to dispense the utensil into the chute and such that whenever the platen holding the napkin is underneath the chute, the door opens to allow the utensil within the chute to gravitationally drop onto the napkin on the platen and thereafter the door closes.

11. The silverware wrapping system as in claim 10 wherein the magazine has a central cavity such that all of the utensils held therein are held in uniformly stacked fashion within the central cavity.

12. The silverware wrapping system as in claim 1 wherein the means for imparting a first fold comprises a pair of fold plates that is capable of pivotally articulating from a normally relaxed position toward the first end of the support base such that whenever the leading corner of the napkin is positioned overtop the fold plates, the fold plates pivotally articulate toward the first end, thereby folding the leading corner onto the body portion of the napkin, the fold plates thereafter returns to the relaxed position.

13. The silverware wrapping system as in claim 1 wherein the means for imparting second folds comprises a pair of fold forks that articulate toward each other and then away from each other to a ready state such that when the platen is located proximate the pair of fold forks, the fold forks articulate toward each other, each fold fork folding a respective one of the side corners onto the body portion of the napkin, and thereafter the fold forks return to the ready state.

14. The silverware wrapping system as in claim 13 wherein the means for imparting second folds further comprises a pair of guide plates each located proximate a respective one of the fold forks, such that a portion of the napkin is located underneath the guide plates whenever the fold forks articulate toward each other.

15. The silverware wrapping system as in claim 1 wherein the platen comprises a first section and a second section, the first section and the second section capable of opening downwardly away from each other and thereafter closing all in trap door fashion, such opening allowing the napkin and utensil to gravitationally fall to the means for rolling.

16. The silverware wrapping system as in claim 1 wherein the platen travels back and forth along a track attached to the support base under control of a motor.

17. The silverware wrapping system as in claim 1 wherein the means for rolling comprises:

a pair of rails;

a first roller located proximate one of the pair of rails;

a second roller located proximate the other of the pair of rails; and such that whenever a napkin and utensil falls between the pair of rails, the first roller and the second roller each rotate in opposing directions thereby rolling the napkin about the utensil.

* * * * *